United States Patent [19]

Wos

[11] 4,137,658

[45] Feb. 6, 1979

[54] INDEX TAB

[76] Inventor: John L. Wos, 89-12 102nd St., Richmond Hill, N.Y. 11418

[21] Appl. No.: 807,199

[22] Filed: Jun. 16, 1977

[51] Int. Cl.[2] ..... A44C 3/00

[52] U.S. Cl. ..... 40/2 R

[58] Field of Search ..... 40/23 A, 360, 2 R

[56] References Cited

U.S. PATENT DOCUMENTS

| | | | |
|---|---|---|---|
| 1,199,418 | 9/1916 | Rand | 40/23 A X |
| 1,938,944 | 12/1933 | Tussing | 40/23 A |
| 1,961,079 | 5/1934 | Pettis | 40/23 A |
| 2,507,659 | 4/1950 | Zalkind | 40/23 A |
| 2,815,595 | 12/1957 | Davis | 40/360 |
| 3,221,430 | 12/1965 | Cunningham | 40/23 A |
| 3,566,522 | 3/1971 | Leach et al. | 40/23 A |

*Primary Examiner*—Louis G. Mancene
*Assistant Examiner*—Wenceslao J. Contreras

[57] ABSTRACT

An index tab comprised of a unitary strip of material folded upon itself to form two slightly spaced and oppositely located walls in approximately parallel relationship joined at a fold line at the top end thereof and the walls each terminating in a bottom end. Attaching means in the form of a doubled strip of flexible material arranged lengthwise within the unitary strip is provided with its sides secured directly to the walls below the top end of the unitary strip, and the lower end of each of the sides extending beyond the bottom end of each of the walls and forming a pair of arms. The inner surface of each one of the arms is coated with an adhesive material. Guard means is interposed between the arms and in face-to-face contacting relation with the adhesive coated surface of the arms. The guard means comprises first and second guard sheets connected at their inner ends intermediate the arms and which sheets are substantially coextensive with the adhesive coated surface of the arms and peelingly stripable therefrom. An extension portion extends downwardly from one of the guard sheets for removal of the guard means by grasping and pulling on the extension portion such that a peeling of the guard sheets from the arms occurs.

10 Claims, 6 Drawing Figures

INDEX TAB

BACKGROUND OF THE INVENTION

1. FIELD OF THE INVENTION

This invention relates to index tabs of the type used for the indexing of data. More particularly, the present invention relates to index tabs constructed of flexible transparent plastic material adapted for attachment to cards or sheets and which have a tab projecting outwardly from the edge of the card or sheet to form a sheath for a label which carries an index designation.

2. DESCRIPTION OF THE PRIOR ART

Index tabs of the general type set forth above are constructed with two oppositely located spaced sidewalls adapted to straddle a card or sheet to which they are to be attached and to form the sidewalls of a sheath for carrying an index label.

In general, index tabs of the type set forth above are attached to cards or sheets by the two oppositely located sidewalls being coated with a non-drying pressure sensitive adhesive which is provided with a protective covering. The user must remove the protective covering from the pressure sensitive adhesive coatings before attaching the index tab to an intended card. It is necessary for the user of the index tab to insert his finger between the two sidewals and forcibly separate them to enable the tab to be placed astraddle a card or sheet.

If the pressure sensitive adhesive coatings are utilized, the sidewalls must be forcibly separated to facilitate the removal of the protective coverings from these adhesive coatings. Care must be exercised to prevent the sidewalls from contacting each other. If the sidewalls contact each other, they may lock in an inoperative condition, requiring separation before the index tab can be placed astraddle the edge of a card or sheet.

Index tabs of the general type set forth above may advantageously be manufactured and sold in strips which are then cut into index tab units of desired lengths by the user. In this manner a plurality of tabs may be prepackaged in a container for sale to the end user.

The need to provide an index tab with a means for separation of the adhesive surfaces prior to mounting the tab on a card or sheet is described in the prior art in U.S. Pat. Nos. 2,507,659 to P. Zalkind and 2,815,595 to K. M. Davis. Applicant has found that an improved index tab assembly is obtained if the removable or guard portion is not comprised of a plurality of portions or sections folded over one another.

In particular, with reference to FIG. 1 of Zalkind, there is disclosed a protective sheet which is joined at a portion exteriorly of the tab itself. Furthermore, the protective sheet is comprised of four overlapping layers, and still does not provide the convenience of the present invention.

The Davis patent teaches a similar construction to that described in Zalkind in that, as clearly illustrated in FIG. 3 of Davis, a plurality of overlapping segments are utilized with respect to the removable portion of the index tab. This prior art construction in addition to requiring a greater amount of paper, or other material from which the disposable portion is fabricated, still gives rise to the easy possibility of occurrence of the adhesive adjacent surfaces becoming bonded to each other.

In Zalkind when a pulling force is applied at the free end of the reentrant flaps, it will be noted that the protective strips are last to leave the area contained between the adhesive elements. Any drag or failure in continuity of movement could result in a premature closing of these leg-like elements, with the result that the adhesive surfaces become prematurely bonded to each other.

As will hereinafter be described, the present invention obviates and overcomes these deficiencies of the prior art in a new and novel manner so as to provide a superior and improved index tab.

OBJECTS OF THE INVENTION

An object of the present invention is the provision of a readily removable surface protecting guard means for the pressure sensitive adhesive surfaces of an index tab.

Yet another object of the present invention is the formation and arrangement of a protective guard sheet so that by its removal it will form and arrange the adhesive coated surfaces of the reinforcement or tab member to facilitate application thereof.

Still another object of the present invention relates to index tabs which may be formed individually or in continuous rolls and be provided with a protective guard sheet in continuous but readily separable form.

SUMMARY OF THE INVENTION

The outstanding and unexpected results obtained by the practice of the apparatus of this invention are obtained by a series of features and elements assembled and working together in interrelated combination. The index tab of the present invention comprises a unitary strip of stiff but flexible material deformably folded upon itself to form two slightly spaced and oppositely located walls in approximately parallel relationship joined at a fold line at the top end thereof and each wall terminating in a bottom end. The walls may be fabricated from a transparent plastic material.

Attaching means in the form of a doubled strip of flexible material arranged lengthwise within the unitary strip with its sides secured directly to the walls below the top end of the unitary strip is provided. The lower end of each of the sides extending beyond the bottom ends of each of the walls and forming a pair of flexible arms, with the inner surface of each one of the arms being coated with an adhesive material.

Guard means is interposed between the arms and in face-to-face relation with the adhesive coated surface of each of the arms and adapted to be readily removed to render the arms free for securement to a sheet or tab. The guard means comprises a first guard sheet having an extension portion extending outwardly from the lower end of one of the arms and being peelingly stripable from the arm surface by grasping and pulling on the extension portion.

A second guard sheet on the adhesive coated surface of the other of the arms, and being peelingly stripable therefrom, is also provided. The first and second guard sheets extend substantially in surface-to-surface relation with each other and are connected at their inner ends intermediate the arms, such that the extension portion may be readily grasped to facilitate removal of the same from within the confines of the cooperating arms.

BRIEF DESCRIPTION OF THE DRAWINGS

The foregoing and other objects, features and advantages of the present invention will become readily apparent to those skilled in the art from a reading of the detailed description hereinafter, when considered in conjunction with the accompanying drawings, wherein:

FIG. 1 is a perspective view of an index tab according to the present invention and manually supported by the user prior to assembly with a sheet or the like;

FIG. 3 is a view similar to FIG. 2 which illustrates the next step in applying the index tab to the sheet or the like;

FIG. 4 continues and illustrates the index tab as attached to the sheet or the like;

DETAILED DESCRIPTION OF THE DRAWINGS

Figure 1:
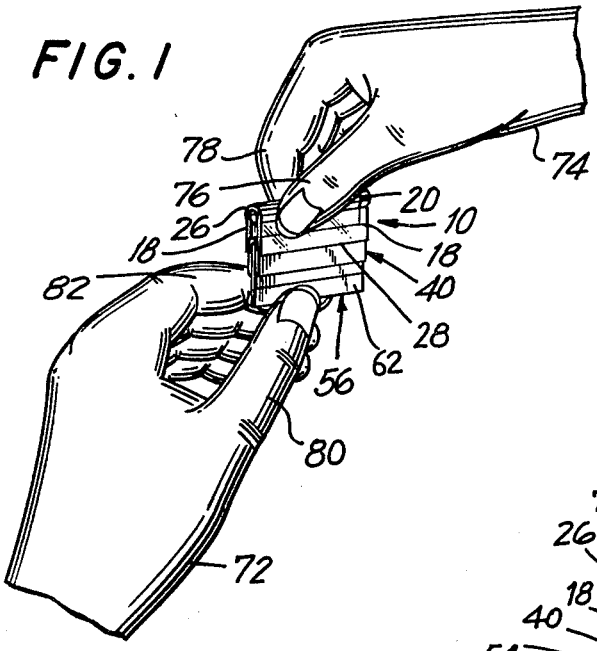

Referring to the drawings, there is illustrated in FIGS. 1 through 6 an index tab 10 adapted to be used with various sheets or pages 12 having opposing surfaces 14 on which the index tab 10 is to be positioned along the leading edge 16 of the sheet 12. The tab 10 may be provided in lengths and the user may appropriately cut the length to selected sizes. If desired, the tabs having oppositely disposed surfaces 18 may be provided in discrete lengths.

The index tab is formed from a unitary strip 20 that may be stiff but flexible and fabricated from a transparent plastic material. The unitary strip 20 may be folded upon itself to form two slightly spaced and oppositely located walls or members 22. The walls 22 extend in approximately parallel relationship to each other and are joined at a fold line or fold area 24 at the top end 26 of the index tab 10. Each wall 22 terminates in a bottom end 28. Each wall 22 has an inner surface 30 and an outer surface 32.

The distance between the inner surfaces 30 defines a pocket or cavity 34 so as to leave an interior portion of the unitary strip 20 in order to receive therein a member 36 which would be held in place and generally have indicia thereon to be viewed.

To readily secure the unitary strip 20 to the opposing surfaces 14 of the sheet 12, there is provided attaching means 40 in the form of a double strip 42 of flexible material arranged lengthwise within the unitary strip 20 and having a fold line 44 at the upper end 46 thereof. The spacing between upper end 46 and the top end 26 determines the size of the pocket 34 for receiving the member 36 therein. The respective sides 48 of the doubled strip 42 are secured directly to the inner surface 30 of each of the walls 22 in a manner well known in the art.

Figure 6:
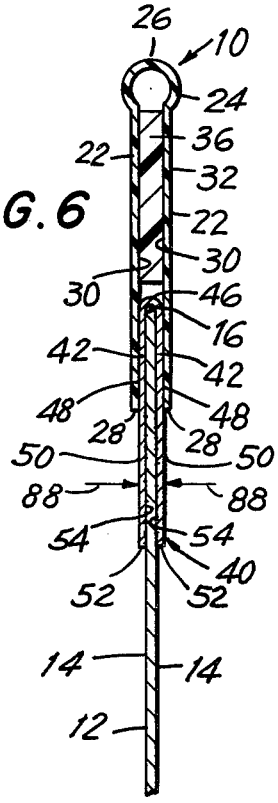
FIG. 6 is an enlarged view taken along line 6—6 of FIG. 4.

Each one of the sides 48 extends beyond the bottom end 28 of the walls 22 so as to form a pair of oppositely disposed flexible arms 50 having an outer or free end 52. The inner surface 54 of each of the arms 50 is coated with an adhesive material in a manner well known in the art. The coating may extend upwardly until the upper end 46 of the attaching means 40 is reached. The above form of index tab 10 has found considerable difficulty to the extent that the adhesive surfaces 54 are to be maintained separate from each other during the sequence of operation until the index tab 10 is completely secured to a sheet 12, as illustrated in FIG. 6.

In order to provide the user of the tab 10 with a simple manner in which to position the tab 10 on the sheet 12, there is provided guard means 56 operably associated with the attaching means 40. The function of the guard means 56 is to permit ready securement in the manner illustrated with respect to FIGS. 1 through 5.

The guard means 56 is interposed between the arms 50, which arms are adapted to move outwardly along the bottom end 28 of walls 22, substantially at the juncture 58. In this manner each arm 50 can act as a flexible flap until brought into final position in assembled relationship with sheet 12. The guard means 56 extends in face-to-face relation with the adhesive coated surface 54 of each of the arms 50. A first guard sheet 60 is provided having an extension or projection 62 extending outwardly and beyond the lower end 52 of one of the arms 50. A second guard sheet or member 64 forms part of the guard means 56 and is releasably secured to the surface 54 of the other arm 50 by the adhesive coating.

The dimensional relationship of the guard means 56 is that the terminal end 66 of the second guard sheet 64 may substantially coincide with the free end 52 of one of the arms 50. With respect to the first guard sheet 60, the extension portion 62 has a free end 68 that extends beyond the free end 52 of the other arm 50. The distance that the projection or extension 62 extends may be in the range of 0.100 to 0.70 inches. An ideal dimension has been found to be approximately 0.40 inches.

The first and second guard sheets 60 and 64, respectively, are connected at their inner ends 70 intermediate the arms 50. The above relationship is such that in the manufactured configuration of the index tab 10, as illustrated in FIG. 1, the overlapping surfaces of the first and second guard sheets 60 and 64 extend substantially in surface-to-surface relation with each other and the inner surfaces 54 of the arms 50.

The configuration of the guard means 56 is such that the tab 10 may be initially held by the hands 72 and 74 of the user. The thumb 76 and index finger 78 of hand 74 may grip the unitary strip 20 at substantially the top end 26 thereof. The opposite hand 72 may have the thumb 80 and index finger 82 grip the opposite sides of the extension portion 62. Once this is accomplished, as illustrated in FIG. 1, removal of the guard means 56 may take place so as to leave the adhesively coated surfaces 54 of arms 50 free to engage the oppositely disposed surfaces 14 of sheet 12.

Figure 2:
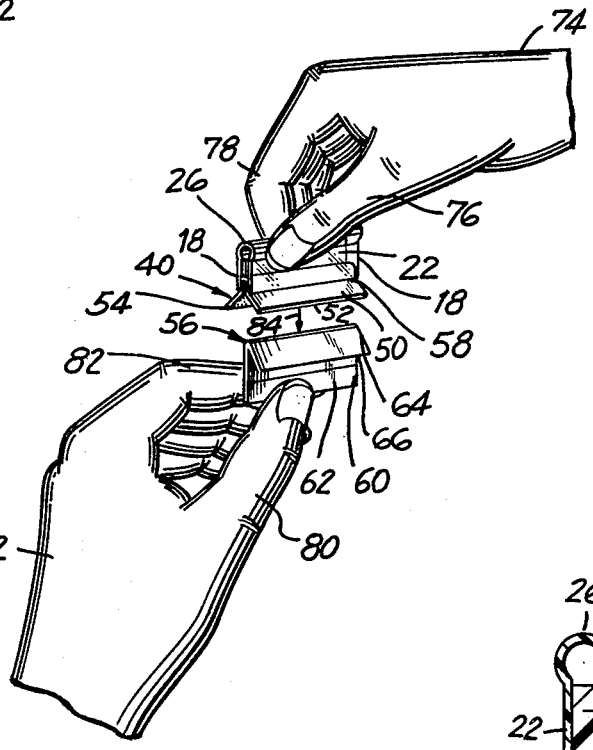
FIG. 2 is a perspective view similar to FIG. 1 illustrating one manner of removal of the guard means associated with the index tab.
Figure 3:
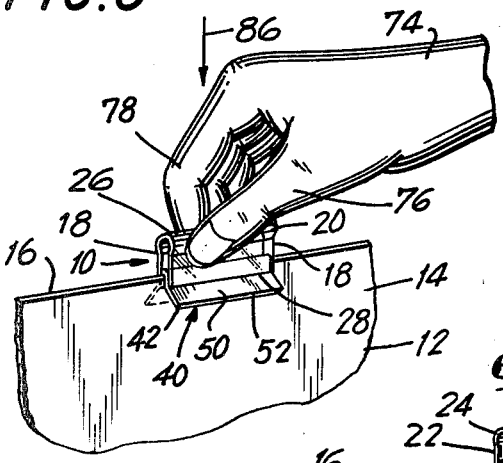
Figure 4:
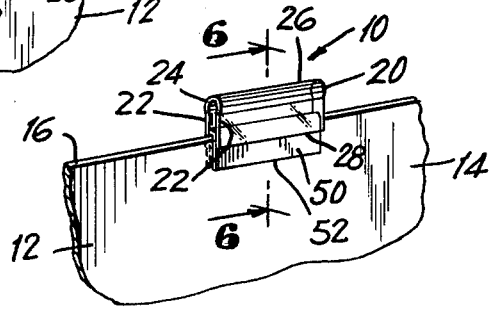

As illustrated in FIG. 2, a downwardly and outwardly directed force, as illustrated by arrow 84, is applied to the extension portion 62. Since the guard sheets 60 and 64 are peelingly strippable from the surfaces 54, a release thereof will take place. Prior to this force being applied, the arms 50 may first be pried apart so as to remain in the outwardly directed inclination, as illustrated in FIGS. 2 and 3. The construction of the guard means 56 is that the user without engaging the adhesive coated surface 54 may pry apart arms 50 by engagement of the guard sheets 60 and 64.

Figure 5:
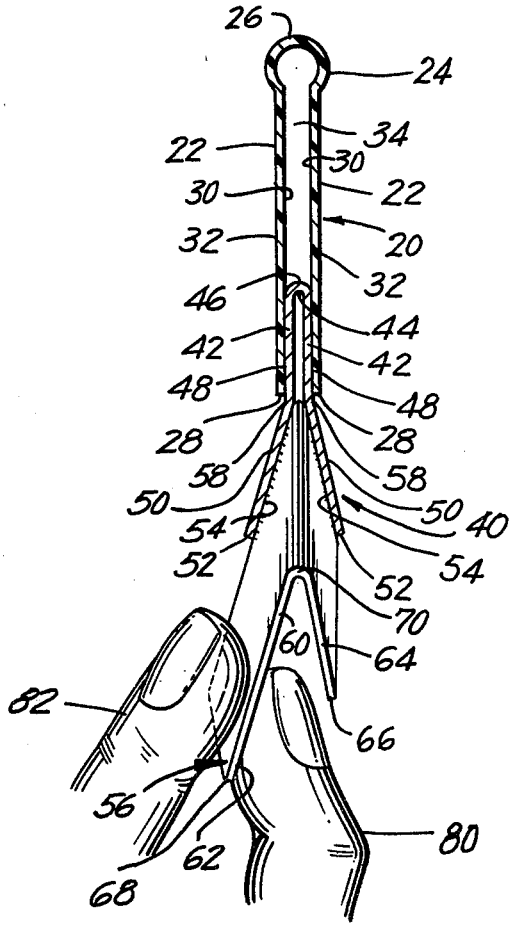
FIG. 5 is an enlarged sectional view illustrating the removal by peeling the guard means from the index tab to expose the adhesive.

To disengage the guard means, the force applied may be gradual in that the user, as illustrated in FIG. 5, may grip one end of the guard means 56 and gradually peelingly strip the guard sheets 60 and 64 along the length thereof extending between the oppositely disposed surfaces 18 of the tab 10. In either event, removal of the guard means 56 permits the user to position the tab 10 with a downward movement, as illustrated by arrow 86 in FIG. 3. In this manner the seated or assembled relationship between the index tab 10 and sheet 12 is reached.

Once the index tab 10 is contained in position, the arms 50 can be readily moved inwardly to engage the opposing surfaces 14 of sheet 12. This is produced by a manual force applied in the direction of opposing arrows 88 illustrated in FIG. 6. In this manner, the user can obtain the desired assembly of the index tab 10 with a sheet 14 in a simple, efficient and convenient manner. The guard means 56 may be fabricated from paper or plastic, and the attaching means 40 from fabric or other materials well known in the art.

The terminal end 66 of the second guard sheet 64 may extend in parallel relationship to the free end 52 of arm 50. By having a single guard means 56 in that the first guard sheet 60 has the extension portion integrally formed therewith and in alignment with the side 48, there is only one fold at the inner end 70 of the guard sheets 60 and 64. This provides for an economical guard means 56 which is readily disposed in predetermined position and then removed when desired to permit the arms 50 to be secured to a sheet 12.

Accordingly, it can clearly be seen that the guard means 56 acts as a simple protective member which may be utilized for an ordinary tab having a pressure-adhering adhesive surface, and the guard means may be readily removed in a single step. At the same time, in the removal of the guard means, it preconditions the tab, by separation of the arms, so that they may easily be applied to the edge of the sheet on which the tab is to serve as an indication.

The extension portion 62 may extend the full length of the unitary strip 20 and be coextensive with the surfaces 18 and extend downwardly from one of the guard sheets 60 or 64. Further, the lower end 52 of one of the arms 50 may extend in substantially a horizontal plane with the free end 68 to permit the guard means 56 to be grasped such that the guard sheets 60 and 64 are substantially simultaneous peelingly strippable from securement with the adhesive layers on the arms 50. The adhesive may be continuous and may extend to the upper end 46 on the double strip 42.

While I have shown and described a preferred embodiment of the present invention, it will be readily apparent to those skilled in the art that there are many modifications, changes, combinations and improvements which may be made herein, without deviation from the present invention or the teachings hereof.

What is claimed is:

1. An index tab comprising a unitary strip of material folded upon itself to form two slightly spaced and oppositely located walls in approximately parallel relationship joined at a fold line at the top end thereof and wherein said walls each terminate in a bottom end, attaching means in the form of a doubled strip of flexible material arranged lengthwise within said unitary strip, said strip having the sides thereof secured directly to said walls and being positioned below said top end of said unitary strip, the lower end of each of said sides extending beyond said bottom end of each of said walls, the lower ends of said side strips forming a pair of arms, said inner surface of each one of said arms being coated with an adhesive material, guard means interposed between said arms and disposed in face-to-face contacting relation with said adhesive coated surfaces of said arms, said guard means comprising first and second guard sheets connected at their inner ends intermediate said arms, said guard sheets being substantially coextensive with said adhesive coated surface of said arms and peelingly strippable therefrom, and an extension portion extending downwardly from one of said guard sheets for removal of said guard means by grasping and pulling on said extension portion such that a peeling of said guard sheets from said arms occurs.

2. An index tab in accordance with claim 1, wherein said double strip of flexible material includes a fold line at the upper end thereof providing an interior portion of said unitary strip unobstructed above said fold line of said double strip.

3. An index tab in accordance with claim 2, wherein said inner ends of said guard sheets extend above said arms and terminate adjacent to and below said fold line of said double strip.

4. An index tab in accordance with claim 1, wherein said unitary strip is fabricated from transparent material.

5. An index tab in accordance with claim 1, wherein said first and second guard sheets extend substantially in surface-to-surface relation with each other prior to removal of said guard means from between said arms.

6. An index tab in accordance with claim 1, wherein said extension portion is integrally formed with one of said guard sheets.

7. An index tab in accordance with claim 1, wherein said extension portion includes a free end, and said free end is disposed in a substantially horizontal plane.

8. An index tab in accordance with claim 7, wherein said arm said extension portion is associated with includes a lower end, and said horizontal plane extends beyond said lower end in the range of from 0.10 to 0.70 inches.

9. An index tab in accordance with claim 7, wherein said extension portion is preferably formed having a dimension of approximately 0.40 inches.

10. An index tab in accordance with claim 1, wherein said unitary strip includes oppositely disposed surfaces at each side thereof, and said extension portion is coextensive with the distance between said oppositely disposed surfaces.

* * * * *